US006305033B1

(12) United States Patent
Azzam

(10) Patent No.: US 6,305,033 B1
(45) Date of Patent: Oct. 23, 2001

(54) HAND-HELD CUSPIDOR WITH REPLACEABLE CUP

(76) Inventor: Bassem B. Azzam, 2636 Via Madalena, Lancaster, CA (US) 93535

( * ) Notice: Subject to any disclaimer, the term of this patent is extended or adjusted under 35 U.S.C. 154(b) by 0 days.

(21) Appl. No.: 09/613,785

(22) Filed: Jul. 11, 2000

(51) Int. Cl.[7] ..... A61J 19/00
(52) U.S. Cl. ..... 4/274; 4/258; 4/285; 220/738
(58) Field of Search ..... 4/271, 274, 285, 4/258, 267; 220/23.89, 23.91, 495.03, 738, 740, 495.01

(56) References Cited

U.S. PATENT DOCUMENTS 963,454 * 7/1910 Meinecke ..... 4/274
994,918 * 6/1911 Greenwood ..... 4/274
1,840,616 * 1/1932 Burke ..... 220/23.89
3,798,682 * 3/1974 Harreld ..... 4/267 X
4,927,047 * 5/1990 Stuber et al. ..... 220/740

FOREIGN PATENT DOCUMENTS

12807 * of 1889 (GB) ..... 4/258

* cited by examiner

*Primary Examiner*—Robert M. Fetsuga
(74) *Attorney, Agent, or Firm*—Allan M. Shapiro

(57) ABSTRACT

The hand-held cuspidor with replaceable cup has a base which receives a replaceable cup. A holder engages on the base and retains the cup in the base. The holder has a handle for manual carrying. A pivoted cover swings from a closed position over the holder to an open position where the replaceable cup is available for expectoration.

8 Claims, 1 Drawing Sheet

HAND-HELD CUSPIDOR WITH REPLACEABLE CUP

FIELD OF THE INVENTION

This invention is directed to a hand-held cuspidor.

BACKGROUND OF THE INVENTION

Those who chew tobacco must expectorate. In generations past, there were brass cuspidors on the floor of a bar next to its brass rail. Often there was sawdust on the floor so that it did not matter if the customer was accurate. However, in many modern jurisdictions it is illegal to expectorate on the sidewalk and/or on public property. Thus, any person who chews tobacco, when he is not on his own grounds, must have a facility for expectoration. This requirement applies not only to a person who chews tobacco directly by chewing a wad of tobacco entirely within the mouth, but also to a person who smokes cigars and clamps the end of the cigar between his teeth.

SUMMARY OF THE INVENTION

In order to aid in the understanding of this invention, it can be stated in essentially summary form that it is directed to a hand-held cuspidor with replaceable cup. The cuspidor has a housing sized to receive a cup, preferably a standard throw-away polymer cup. The user carries the cuspidor containing the cup with him and, when the need arises, he expectorates into the cup. The housing preferably has a cover thereon for covering the cup between uses.

It is thus a purpose and advantage of this invention to provide a hand-held cuspidor so that the chewer of tobacco can carry it with him so that the cuspidor is always available, as needed.

It is another purpose and advantage of this invention to provide a hand-held cuspidor which has a standard throw-away foam polymer cup therein so that the portion of the cuspidor which becomes soiled with expectorant can be easily and economically thrown away and replaced with a new cup.

It is another purpose and advantage of this invention to provide a hand-held cuspidor which is economic of construction so that any user of chewing tobacco can afford to carry this sanitary convenience.

The features of this invention which are believed to be novel are set forth with particularity in this specification. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
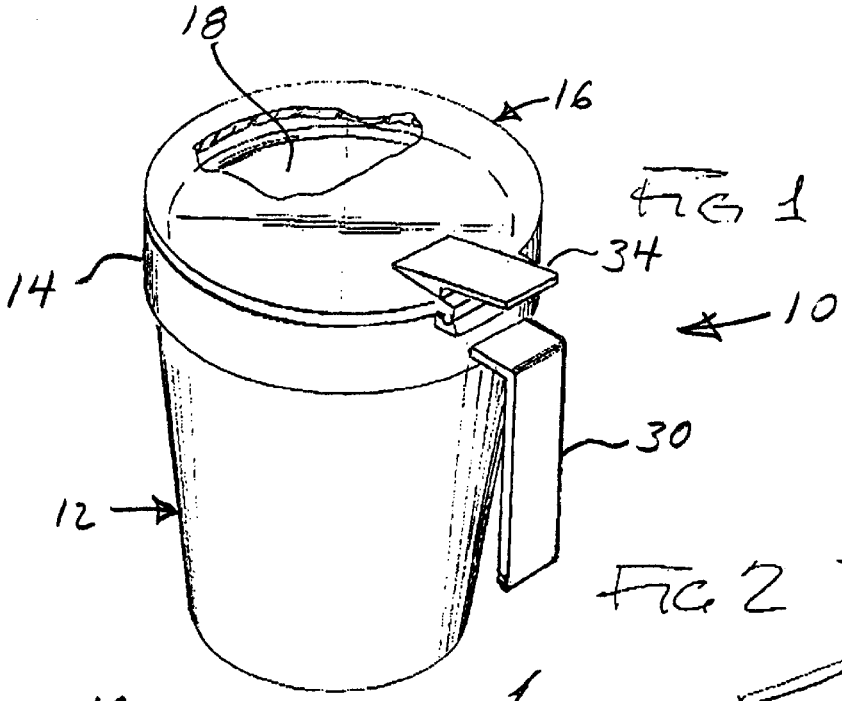
FIG. 1 is a perspective view of the hand-held cuspidor with replaceable cup in accordance with this invention.
Figure 2:
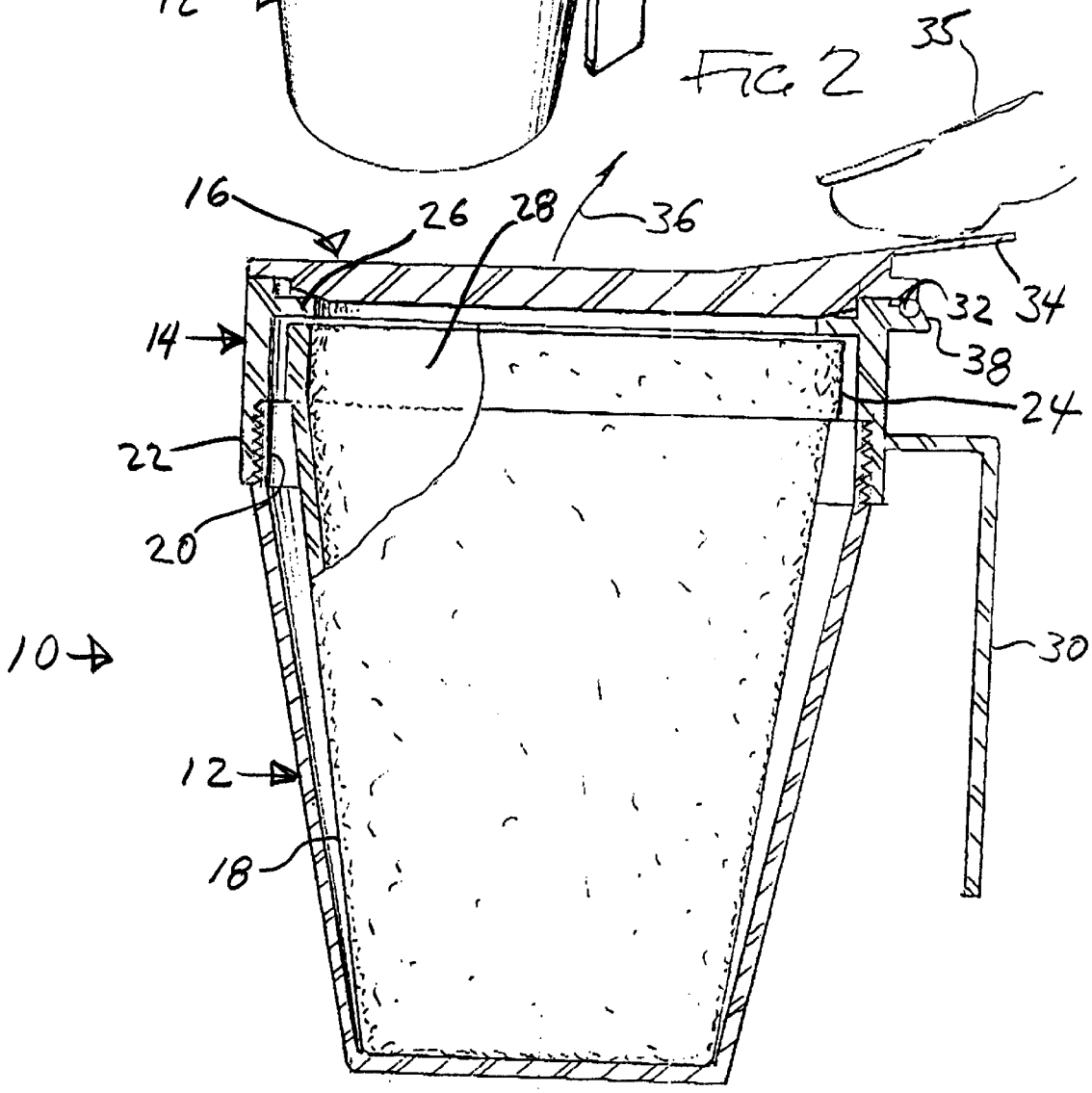
FIG. 2 is a vertical axial section through the cuspidor and a side elevational view of the replaceable cup, with parts of the cup broken away and taken in section.

The hand-held cuspidor with replaceable cup is seen at 10 in FIGS. 1 and 2. The cuspidor 10 comprises base 12, holder 14 and cover 16. The base 12 is a hollow truncated conical structure serves as a stop and preferably made of injectionmolded synthetic polymer composition material. It is sized to receive a standard polymer cup 18, preferably of the inexpensive type made of expanded polystyrene. Such are available in six- and eight-ounce sizes. Base 12 terminates with upper externally threaded attachment collar 20. The entire base, except for the threads on the exterior of the attachment collar, is a body of revolution around a central axis.

Holder 14 is generally in the shape of a right circular cylindrical tube. It extends down over the attachment collar 20 and has an internally threaded section 22 which threadedly engages on the attachment collar 20 Above the threaded section 22, the holder 14 is a cylindrical tube embracing the lip 24 of cup 18. Above the lip 24, the holder 14 has an inwardly directed circular flange 26 which engages over the top of the lip 24 to retain cup 18 within base 12 and holder 14. The flange 26 extends radially inward to be substantially in line with the interior surface 28 of the cup 18. This structure serves as a stop and retains the cup in place within the holder and base. The cuspidor is opened by unscrewing the base from the holder. Thereupon, the cup 18 is replaced with a new similar cup. The holder 14 has a handle 30 which is manually graspable so that the base and the holder can be conveniently carried around and used.

As an additional sanitary feature, cover 16 is configured to overlie the holder when closed, and is configured to expose the entire interior opening of flange 26 when the cover is open. The cover is generally circular so that, when closed, it overlies the top edge of holder 14. Cover 16 is hinged on the holder on pivot pin 32 which lies over the handle 30. The cover has an actuating finger 34 which overlies the handle. The structure is ergonomically configured so that, when the handle 30 is grasped in the fingers, the user's thumb 35 overlies actuating finger 34 so that the cover can be flipped open in the direction of arrow 36. There is a stop surface 38 which is engaged by the cover to limit the open position of the cover at a point where it is about 45° above the horizontal and overlying handle 30, when the axis of the holder and base is vertical. In this position the actuating finger 34 extends below stop surface 38 so that the actuating finger can be engaged to close the lid. Furthermore, in this position the lid overlies the handle so as to protect the user's hand from misdirected expectorant. After it is used, the lid is closed by engaging the actuating finger 34 or simply flipping it closed by engagement of the thumb against the top surface of the cover.

The hand-held cuspidor 10 can be used by flipping open cover 16 and expectorating into the throw-away cup 18. After one or several uses, when it is convenient to the user, the user opens the cuspidor and removes and replaces the cup 18. The old cup can be disposed of in a sanitary manner. The hand-held cuspidor is then ready for reuse. It is anticipated that the hand-held cuspidor will find usage especially at sporting events where the attending fans do not have a sanitary place where they can expectorate.

This invention has been described in its presently contemplated best embodiments and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A hand-held cuspidor comprising:

a housing, said housing being comprised of a holder and a base, said holder and said base being detachably secured together, said holder having a top edge, said base being for receiving a disposable cup with the top of the cup being below said top edge of said holder, a handle on said housing, said handle being sized to be grasped by the user to carry said hand-held cuspidor, a stop flange within said holder to engage over the top of the cup to releaseably retain a disposable cup within said base, said housing being sized to be held in the hand so that it can be carried along with the user so that, when there is a disposable cup within said housing, the user can expectorate therein;

a movable cover pivoted on said housing, said cover having a closed position and an open position and, when it is in said closed position, said cover closes said housing to prevent access to the interior thereof and, when in said open position, permits the user to expectorate into a disposable cup within said housing.

2. The hand-held cuspidor of claim 1 including a pivot stop interengaging between said cover and said housing to define the open position of said cover with respect to said housing, said cover being positioned over said handle in the open position of said cover to protect said handle and the user's hand thereon from misdirected expectorant.

3. The hand-held cuspidor of claim 1 wherein said base is detachably attached to said holder by means of interengaging screw threads.

4. The hand-held cuspidor of claim 1 wherein said cover overlies said handle when it is in its open position.

5. A hand-held cuspidor comprising:

a housing, said housing having an open interior to receive and releasably retain a throw-away cup, said housing being formed of a base and a holder, said base having an open interior to receive the throw-away cup and said holder having a stop flange in the interior thereof positioned to overlie the top of a throw-away cup in said base to retain the cup within said housing, said holder being open interiorly of said stop flange, said base being releaseably attached to said holder for removable replacement of the throw-away cup therein; and a cover pivotally mounted on said holder for movement between a first, closed position wherein said cover lies on said holder to close the cup and a second, open position, said second, open position being sufficiently open so that the replaceable cup is accessible for expectoration, said cover being manually operable by the person holding said hand-held cuspidor.

6. The hand-held cuspidor of claim 5 wherein said base engages said holder by means of interengaging screw threads.

7. The hand-held cuspidor of claim 5 wherein there is a cover pivot stop interengaged between said cover and said holder so that, when said cover is in said second, open position, said cover overlies at least a portion of the user's hand when he is carrying said hand-held cuspidor.

8. The hand-held cuspidor of claim 7 wherein there is a manually engageable handle attached to said holder and said manually engageable handle is positioned beneath said cover when said cover is in the second position, said cover having a manually engageable actuating finger positioned so that a person holding said handle with one hand can engage said cover actuating finger with the same hand to move said cover from its first to its second position.

* * * * *